US005443687A

United States Patent [19]

Koyama et al.

[11] Patent Number: 5,443,687

[45] Date of Patent: Aug. 22, 1995

[54] METHOD FOR MANUFACTURING AN INK JET HEAD HAVING AN IMPROVED DISCHARGING PORT SURFACE

[75] Inventors: Shuji Koyama, Kawasaki; Yukio Kawajiri, Yokohama; Makoto Shibata, Kawasaki; Manabu Sueoka, Yokohama; Toshio Suzuki, Inagi; Hisashi Yamamoto, Machida; Takumi Suzuki, Yokohama, all of Japan

[73] Assignee: Canon Kabushiki Kaisha, Tokyo, Japan

[21] Appl. No.: 969,355

[22] Filed: Oct. 30, 1992

[30] Foreign Application Priority Data

Oct. 30, 1991 [JP] Japan ..... 3-284673

[51] Int. Cl.[6] ..... B44C 1/22

[52] U.S. Cl. ..... 216/27; 216/67; 216/51

[58] Field of Search ..... 156/643, 644, 630, 633, 156/655, 659.1; 346/1.1, 140 R

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,073,785 | 12/1991 | Jansen et al. | 346/1.1 |
| 5,140,345 | 8/1992 | Komuro | 156/630 X |

FOREIGN PATENT DOCUMENTS

| | | |
|---|---|---|
| 3735372 | 4/1988 | Germany . |
| 54-56847 | 5/1979 | Japan . |
| 59-123670 | 7/1984 | Japan . |
| 59-138461 | 8/1984 | Japan . |
| 60-71260 | 4/1985 | Japan . |
| 229749 | 7/1990 | Japan . |

OTHER PUBLICATIONS

Patent Abstracts of Japan, vol. 12, No. 316 (C-524) (3163) Aug. 26, 1988 & JP-A-63-086871 (S. Okazaki) Apr. 18, 1988.

Patent Abstracts of Japan, vol. 12, No. 55 (M-669) (2902) Feb. 19, 1988 & JP-A-62-202743 (Y. Katano) Sep. 7, 1987.

*Primary Examiner*—William A. Powell

*Attorney, Agent, or Firm*—Fitzpatrick, Cella, Harper & Scinto

[57] ABSTRACT

A method for manufacture of an ink jet head comprises the process of forming a head main body by providing a positive resist layer to constitute ink passages for a substrate having ink ejection pressure generating means and then a ceiling member therewith; forming a carbon-contained film for the surface where the ink discharging ports of the head main body are formed; conducting a fluoric plasma treatment given to the carbon-contained film by utilizing a hydrofluoride compound; and removing the positive resist layer. With this method, an F-C coupled water repellent film is formed on the discharging port formation surface of an ink jet recording head evenly with a desirable bonding capability to enhance the reliability of water repellency.

7 Claims, 6 Drawing Sheets

METHOD FOR MANUFACTURING AN INK JET HEAD HAVING AN IMPROVED DISCHARGING PORT SURFACE

BACKGROUND OF THE INVENTION

1. Field of the Invention

The present invention relates to an ink jet recording head and method for manufacturing the same. More particularly, the invention relates to an ink jet recording head for which the water repellency treatment for its discharging port surface is improved, and method for manufacturing the same.

2. Related Background Art

The water repellent film for an ink jet recording head has hitherto been formed by transferring the fluoric copolymer film which has cyclic structure in its principal chain, by coating with absorbent, or formed by spray coating. FIGS. 4 and 5 are views showing the method of formation of the conventional water repellent film for an ink jet recording head. In the conventional technique, the water repellent film formation method is roughly divided into two depending on the difference in head fabrication processes, that is, the two types: one wherein the water repellent film is formed subsequent to the formation of discharging ports such as shown in FIG. 4, and the other wherein subsequent to the formation of water repellent film such as shown in FIG. 5, the discharging ports are formed.

An ink jet recording head 100 shown in FIG. 4A is formed in such a manner that on an ink jet substrate 101 where exothermic resistive elements and others are incorporated, ink passages 102 are formed, a ceiling plate 103 is adhesively bonded, a discharging port surface 105 is cut, and then discharging ports 104 are formed.

To such an ink jet recording head 100, a water repellent film 107 adhering to silicone rubber 106 is transferred. After that, it is hardened by heating (FIG. 4B). The water repellent film is formed by coating a water repellent solvent over the silicon rubber 106 by means of spin coat.

Thus, an ink jet recording head coated with the water repellent solvent 107 is completed (FIG. 4C).

For an ink jet recording head 100 shown in FIG. 5A, the ink passages are patterned by means of positive resist in order to form the ink passages in the ink jet substrate 101 where exothermic resistive elements and others are incorporated, and then molding resin is poured to form the ceiling plate 103. After that, this is cut to form the discharging port surface 105. To such an ink jet recording head 100, the water repellent solvent which has been absorbed into the absorbent 109 is transferred. Then, it is hardened by heating (FIG. 5B). In order to cause the water repellent solvent to adhere to the absorbent 109, the absorbent is immersed in the original liquid of the water repellent solvent or its diluted liquid to allow it to absorb the water repellent solvent. Then, the positive resist 108 is removed by application of aceton. Thus, when the water repellent film on the discharging port portion is given a pressurized cleaning, the ink passages 102 are formed, and an ink jet recording head coated with the water repellent film 107 is completed (FIG. 5C).

There has also been an ink jet recording head which is fabricated in such a manner that the water repellent solvent absorbed into the absorbent 109 is transferred to the discharging port surface of a grooved ceiling plate formed integrally with a liquid chamber, liquid passages, and an orifice surface, and then after hardened by heating, the grooved ceiling plate is machined by means of excimer laser drilling to be integrated with the substrate 101.

However, with the conventional examples described above, it is difficult to coat the water repellent solvent evenly, leading to the lowered reliability of the water repellency of the ink jet recording head due to such an unevenness of the water repellent solvent thus coated. Also, according to the above-mentioned examples, the adhesiveness between the water repellent solvent and the ink jet recording head is not strong enough. For example, therefore, the repeated cleaning processes performed by a blade cause the water repellent film to be peeled off. As a result, the ink ejection condition of the ink jet recording head is degraded in some cases. Thus, the reliability of the water repellent film is lowered.

SUMMARY OF THE INVENTION

The present invention is designed with a view to improving the situations brought about by the problems described above. It is an object of the invention to provide an ink jet recording head having a discharging port surface for which a reliable water repellent treatment is achieved, and method of manufacture thereof.

It is another object of the present invention to provide an ink jet recording head having a long-term reliability with a treatment given to improve the surface quality of the discharging port surface as well as a water repellent process to improve its adhesiveness, and method of manufacture thereof.

It is still another object of the present invention to provide the method of manufacture of an ink jet recording head comprising the following steps of:

- a formation process of a head main body structured with the arrangement of a positive resist layer to constitute ink passages on the substrate where ink ejection pressure generating means is provided, and with a ceiling plate provided therefor;
- a formation process of a carbon-contained film for the ink discharging surface of the recording head main body;
- a fluoric plasma treatment process given to the carbon-contained film by utilizing a hydrofluoride compound; and
- a removal process for the positive resist layer.

It is a further object of the present invention to provide the method of manufacture of ink jet recording head comprising the following steps of:

- a formation process of a head main body the discharging port surface of which is structured with a carbon-contained material;
- a fluoric plasma treatment process given to the carbon-contained film by utilizing a hydrofluoride compound; and
- a formation process of the discharging ports on the discharging port formation surface by utilizing laser.

It is still a further object of the present invention to provide an ink jet recording head fabricated by the following steps of:

- a formation process of a head main body structured with the arrangement of a positive resist layer to constitute ink passages on the substrate where ink ejection pressure generating means is provided, and with a ceiling plate provided therefor;

a formation process of a carbon-contained film for the ink discharging surface of the recording head main body;

a fluoric plasma treatment process given to the carbon-contained film by utilizing a hydrofluoride compound; and a removal process for the positive resist layer.

It is another object of the present invention to provide an ink jet recording head fabricated by the following steps of:

a formation process of a head main body the discharging port surface of which is structured with a carbon-contained material;

a fluoric plasma treatment process given to the carbon-contained film by utilizing a hydrofluoride compound; and a formation process of the discharging ports on the discharging port formation surface by utilizing laser.

DETAILED DESCRIPTION OF THE PREFERRED EMBODIMENTS

Embodiment 1

FIGS. 1A to 1D are cross-sectional views showing the method of manufacture to form a water repellent film for an ink jet recording head according to the present invention.

Figure 1A:
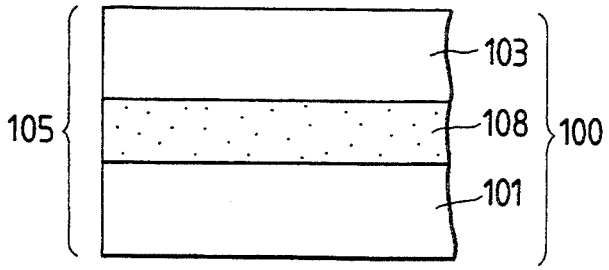
FIGS. 1A to 1D are cross-sectional views schematically illustrating an example of the method for manufacturing an ink Jet recording apparatus according to the present invention.

For an ink jet recording head 100 shown in FIG. 1A, ink passages are patterned by means of positive resist 108 in order to form ink passages for an ink jet substrate 101 where exothermic resistive elements and other are incorporated. Then, molding resin is poured to form a ceiling 103. After that, this is cut to form the discharging port surface 105 which is here represented as its entire image.

Now, the description will be made of the method for forming an F-C coupled water repellent film to be formed on the discharging port surface.

At first, on the discharging port surface of the ink jet recording head, a carbon film 110 is formed. For a method for forming the carbon film, at least one of the discharging plasma method, physical deposition method or chemical deposition method is employed. It is possible to apply either one of them independently or apply two or more methods in combination. An example of these carbon film formation methods will be described.

Figure 1B:
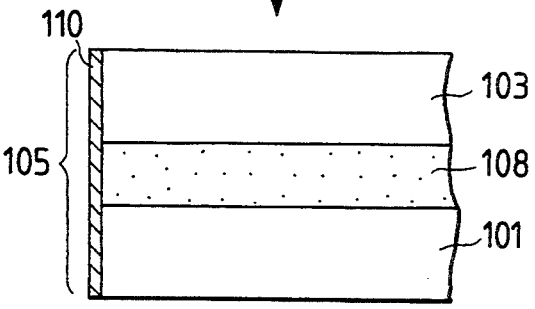
Figure 1C:
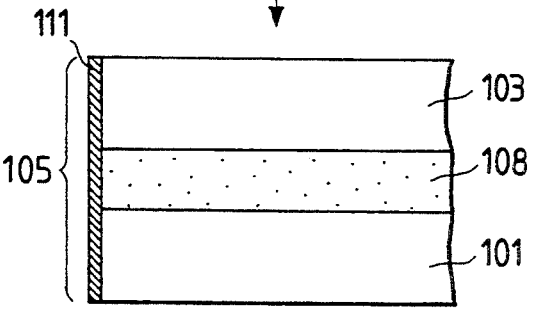

To exemplify a physical deposition method specifically, a carbon target is fixed to an upper electrode (RF electrode) while an ink jet recording head 100 is fixed on a jig on the lower electrode (arc electrode) with its face for the discharging ports to be formed upward in an Ar atmosphere of approximately less than 0.1 Torr, for example. Subsequently, an electric discharge is given across the electrodes to form the carbon film 110 on the discharging port formation surface (FIG. 1B). After the carbon film of 0.2 $\mu$m thick is formed on the discharging port formation surface, the electric discharge is given again with the presence of nitrogen fluoride compound. Then, the fluoric plasma generated by this discharge is allowed to contact with the discharging port formation surface in order to form the F-C coupled water repellent film 111 on the discharging port formation surface (FIG. 1C). For the electric discharging method, a high frequency discharge, microwave discharge, electronic cyclone resonance discharge, and the like can be named.

Also, for the method for electric discharge treatment, it may be possible to determine the discharging conditions appropriately in accordance with the properties required by the discharging port formation surface among those conditions to be created by the fluoric plasma. Here, in the present embodiment, the fluoric plasma generating conditions are set on the basis of those conditions disclosed in U.S. Pat. No. 5,073,785 or Japanese Patent Publication No. 2-29749. For the fluoric compound, $NF_3$ is particularly suitable for use. (The same is applicable to the embodiments set forth below).

Figure 1D:
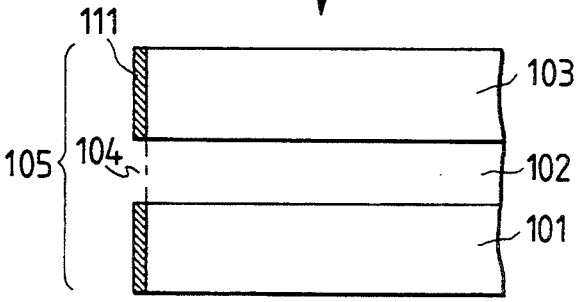

Subsequently, the positive resist 108 is removed by the application of acetone in order to from the ink passages 102. Then, when the water repellent film on the discharging port portion is cleaned under compression, the ink jet recording head is completed with the F-C coupled water repellent film 111 thus formed thereon (FIG. 1D). The process where the foregoing fluoric plasma is allowed to contact with the discharging port formation surface is not necessarily executed immediately after the formation of the carbon film, but it may be possible to form the carbon film and remove the positive resist earlier than such a process because the C-F coupling by the treatment using the fluoric plasma is selectively given only to the portion where the carbon has been formed. The water repellency is completed after the positive resist has been removed. Therefore, there is no degradation of the characteristic of the water repellent film due to the removing solvent applied to removing the positive resist. Furthermore, there is no possibility that it becomes impossible to remove the positive resist sufficiently due to the completed water repellent film on the discharging port portion. This is, therefore, a processing sequence finely suited for the purpose.

The ink contacting angle of the water repellent film thus produced for an ink jet recording head is 120 degrees. To examine the adhesiveness of the water repellent film, a rubbing durability test is executed more than 2,000 times, but the water repellent film is not peeled off. The test condition is:

Ink used for the test is a clear ink which does not contain any dyes, and the composition is: PEG=15%, IPA=3%, and water, 82%.

The ink contacting angle of the base material (oxidized film) before the carbon film is formed is 15 degrees. It becomes 60 degrees after the formation of the carbon film.

Embodiment 2

Figure 2A:
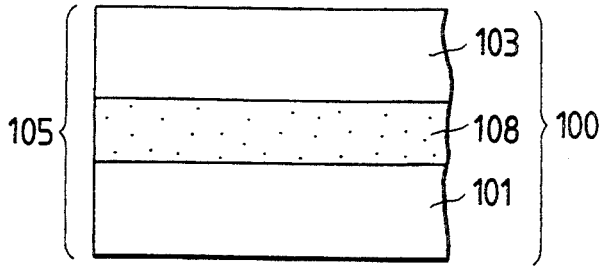
FIGS. 2A to 2D are cross-sectional views schematically illustrating an example of the method for manufacturing an ink jet recording apparatus according to the present invention.

For an ink jet recording head 100 shown in FIG. 2A, the positive resist is patterned in order to form ink passages on the ink jet substrate 101 where exothermic resistive elements and other are incorporated and then molding resin is poured to form the ceiling 103. After that, it is cut to form the discharging port surface 105.

Figure 2B:
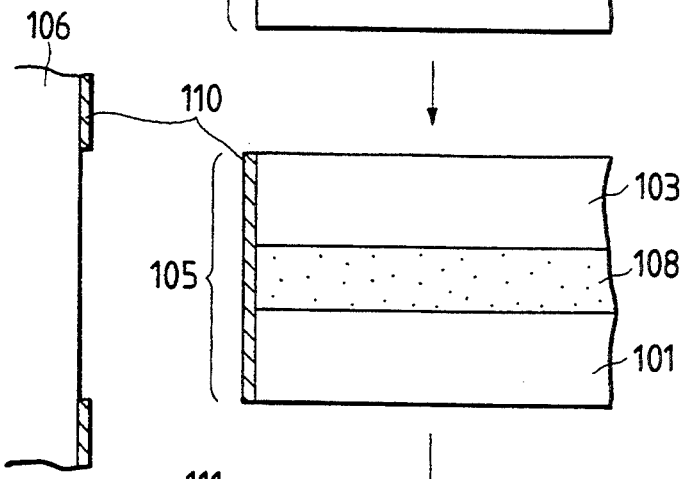

At first, on the discharging port surface of the ink jet recording head, a carbon film is formed. For a method for forming the carbon film, the transfer of a carbon-contained material by the use of silicon rubber 106 is employed (FIG. 2B). It is possible to form a carbon-contained film by coating the silicon rubber with the carbon-contained material by the application of spin coating. Such a carbon-contained film may be replaced with a positive resist (FOPR-800: Tokyo Ohka Inc.) or the like.

Figure 2C:
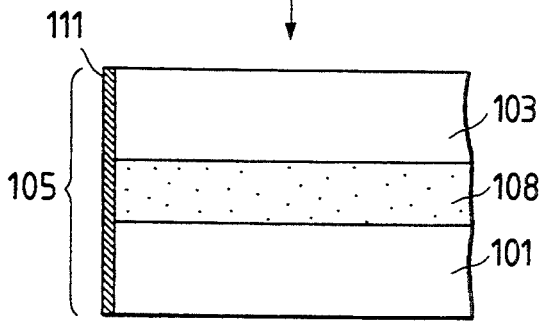

After the formation of the carbon-contained film on the discharging port surface, an electric discharge is given with the presence of nitrogen fluoride compound. Then, the fluoric plasma generated by this discharge is allowed to contact with the discharging port surface in order to form the F-C coupled water repellent film on the discharging port surface (FIG. 2C). For the electric discharging method, a high frequency discharge, microwave discharge, electronic cyclone resonance discharge, and the like can be named.

Figure 2D:
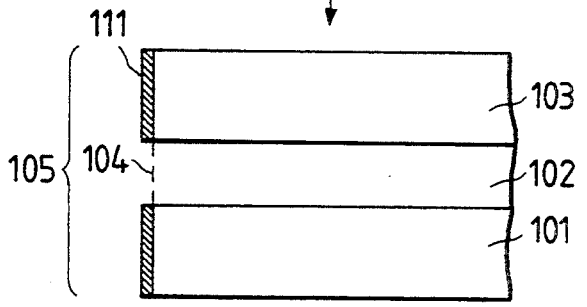

Subsequently, the positive resist 108 is removed by the application of aceton for the formation of the ink passages 102. Then, when the water repellent film on the discharging port portion is cleaned under compression, the ink jet recording head is completed with the F-C coupled water repellent film 111 thus formed thereon (FIG. 2D). This F-C coupled water repellent film at 111 is Teflon-lined so as not to be dissolved even when immersed in aceton solution. In this respect, for the same reason given in the case of the first embodiment, it may be possible to reverse the processing sequence of the removal of the positive resist and the fluoric plasma treatment.

The ink contacting angle of the water repellent film thus produced for an ink jet recording head is 120 degrees as in the first embodiment. The water repellent film is not peeled off even after the rubbing durability test for more than 2,000 times.

Embodiment 3

Figure 3A:
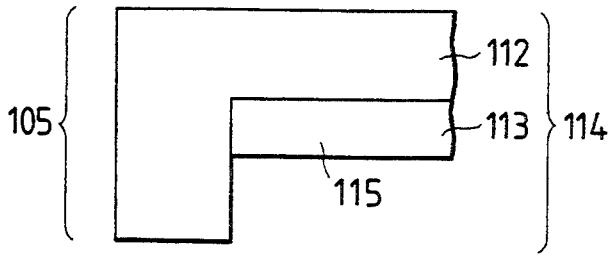
FIGS. 3A to 3C are cross-sectional views schematically illustrating an example of the method for manufacturing an ink jet recording apparatus according to the present invention.
Figure 3B:
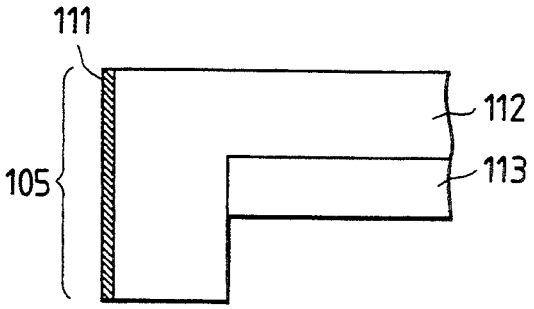

The grooved ceiling plate 114 which is shown in FIG. 3A is formed integrally with a liquid chamber, liquid passages, and an orifice surface. As its material, polysulfone is used. The polysulfone is composed of carbon=73.3%, oxygen=14.5%, sulphur=7.2%, and hydrogen=5%. The carbon content of the polysulfone is great. Therefore, with this, it is unnecessary to form the carbon film as in the cases of the first and second embodiments.

Figure 3C:
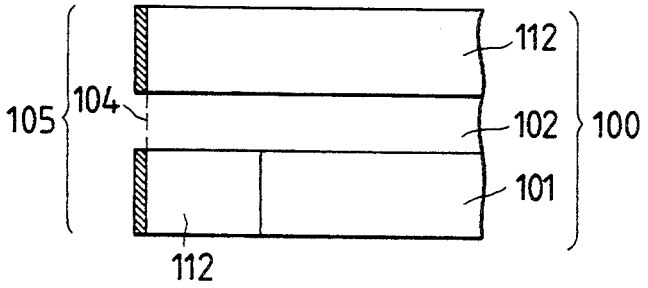
Figure 4A:
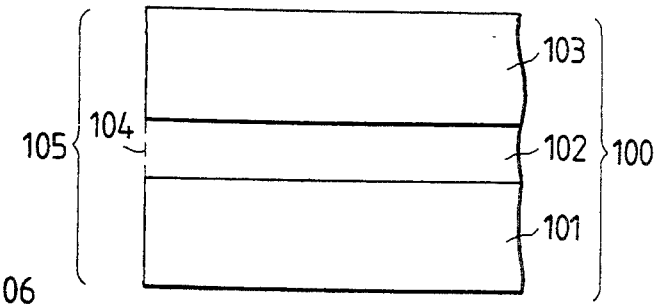
FIG. 4A PRIOR ART
FIGS. 4A to 4C are cross-sectional views schematically illustrating an example of the method for manufacturing a conventional ink Jet recording apparatus according to the present invention.
Figure 4B:
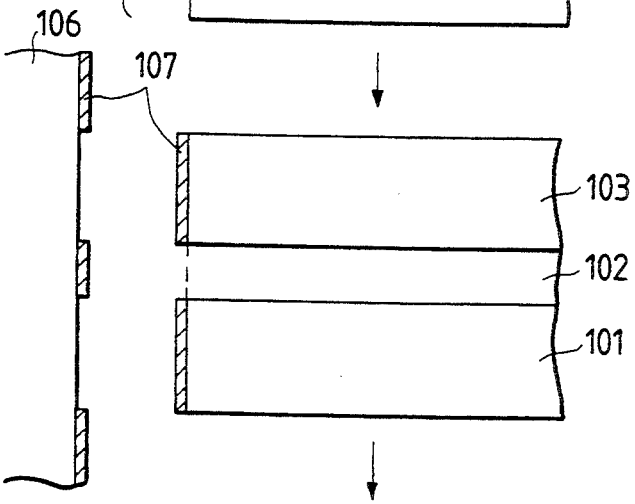
FIG. 4B PRIOR ART
Figure 4C:
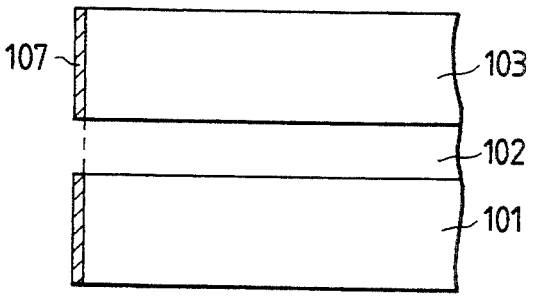
FIG. 4C PRIOR ART
Figure 5A:
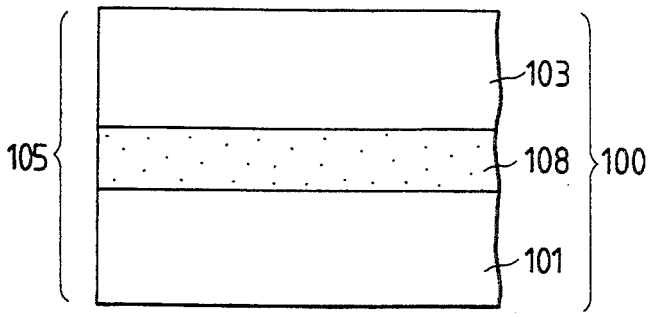
FIG. 5A PRIOR ART
FIGS. 5A to 5C are cross-sectional views schematically illustrating an example of the method for manufacturing a conventional ink jet recording apparatus according to the present invention.
Figure 5B:
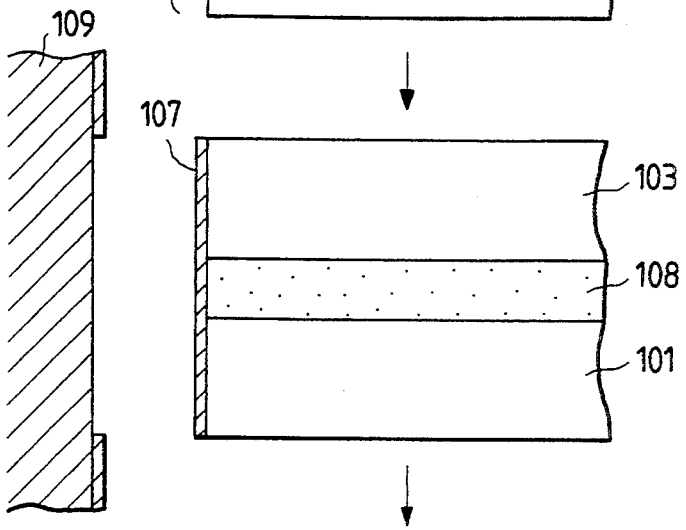
FIG. 5B PRIOR ART
Figure 5C:
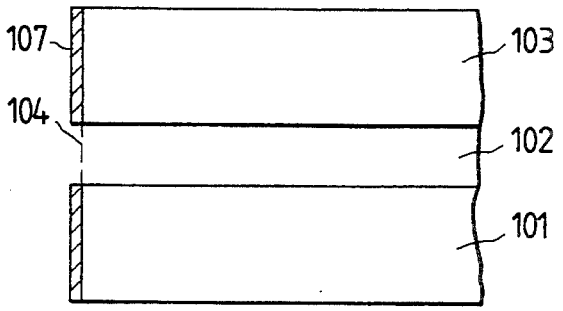
FIG. 5C PRIOR ART

Then, a discharge is given with the presence of a nitrogen fluoride compound, and the fluoric plasma thus generated is allowed to contact with the discharging port surface in order to form the F-C coupled water repellent film on the discharging port surface (FIG. 3C). For the electric discharging method, a high frequency discharge, microwave discharge, electronic cyclone resonance discharge, and the like can be named.

Subsequently, the ink passages are formed by drilling by means of excimer laser or the like to constitute the discharging ports. After that, when this grooved ceiling plate with holes thus provided is bonded to the ink jet substrate 101, the ink jet recording head 100 will be completed. Here, the laser drilling is conducted after the formation of the water repellent film. Therefore, there is no possibility that the water repellent film is drawn into the interior of the discharging ports when the water repellent film is formed. It is thus most preferable to conduct the formation of the water repellent film in this sequence of processes.

The ink contacting angle of the water repellent film thus produced for an ink jet recording head is 120 degrees as in the first embodiment. The water repellent film is not peeled off even after the rubbing durability test for more than 2,000 times.

The ink contacting angle of the supporting member (polysulfone) before the discharge of the fluoric plasma is 55 degrees.

In this respect, when a material containing carbon such as polysulfone is used for the formation of a head substrate including the discharging port formation surface, it is possible to produce an ink jet head more desirably in a fashion given below.

In other words, subsequent to the formation of a metallic film on the liquid chamber portion of the grooved ceiling plate 114 and the inner portion (where ink passages are formed) 115 of the discharging ports, the fluoric plasma treatment is allowed to contact with the grooved ceiling plate 114 entirely. Then, due to the presence of carbon, a C-F coupling is created to form a water repellent film on the discharging port formation surface when the fluoric plasma is in contact with the grooved ceiling plate 114 entirely, and also, in the liquid chamber and the portion 115 where the ink passages are formed, a metallic hydrofluoride film is created to give them a hydrophilic property. When the liquid chamber and ink passage formation portion 115 become phyrophilic, bubbles can hardly adhere to these portions. As a result, there will be no adverse effects produced due to the presence of bubbles; thus making it possible to form an ink jet head having an excellent ink discharging capability.

Embodiment 4

At first, only on a portion where discharging ports are formed in an SUS304 board, a pattern formation is conducted by a photolithographic technique using a negative type DF (SE-238: Tokyo Ohka Inc., for example). Then, using an Ni film formation electrolytic plating solution, the pattern is formed to be in a thickness of 40 $\mu$ by the application of an electrolytic plating. Subsequently, a carbon film is formed. For the film formation method, the same method as in the embodiments 1 and 2 are employed.

Further, fluoric plasma is allowed to contact with the discharging port surface to provide water repellency. Lastly, the Ni plated film is peeled off from the SUS board to complete an orifice plate.

Then, the foregoing orifice plate is bonded to a substrate where heaters and an ink supplying inlet are formed thereby to complete the element. Thus, with electrical connections and an ink tank mounted, an ink jet recording head is completed.

In the same way as the embodiments 1, 2, and 3, the adhesiveness test is conducted for a head structured as above. Then, there is no water repellent film which has been peeled off. In the present embodiment, when the carbon film is formed, no carbon film adheres to the reverse side of the orifice plate because DF is provided for the SUS plate discharging ports on the reverse side of the orifices. Then, no water repellency is given to the reverse side of the orifice plate as in the case of the carbon film formation when the fluoric plasma is allowed to contact with the discharging port surface.

Also, it may be possible to perform this in the process given below. In other words, the process for the fluoric plasma to contact with the discharging port surface is executed after the Ni plated film is peeled off from the SUS board so that such contact is performed over the entire body.

In this way, water repellency is given to the discharging port surface because it has the carbon film while on the reverse side of the orifice plate, an Ni hydrofludie is created to provide hydrophilic property because the Ni is exposed thereon. Therefore, the liquid chamber and the inner part of the nozzles become hydrophic while the discharging port surface becomes water repellent. Thus, for the ink jet recording head, its ejection capability is enhanced more than just providing water repellency only to the discharging port surface and a desirable printing can be obtained. This is because, as described in conjunction with the embodiment 3, if the interior of the nozzles is hydrophilic, there will be no bubbles to remain therein; hence eliminating any defective ejection due to the excessive bubbles.

As described above, the discharging port surface is prepared to be in a state that carbon can exist and then a fluoric plasma treatment is given thereto; thus providing an F-C coupled water repellent film to obtain the following effect:

(1) The reliability of water repellency is enhanced because the F-C coupled water repellent film can be formed evenly on the discharging port surface of an ink jet recording head.

(2) The water repellent film is not peeled off because the F-C coupled water repellent film formed on the discharging port surface of the ink jet recording head has an excellent bonding capability and thus it enables the reliability of the water repellent film for the ink jet recording head to be enhanced.

Of the ink jet recording methods, the present invention is particularly effective and produces excellent effects in applying to an recording head and recording apparatus using an ink jet recording method wherein flying droplets are formed by the utilization of thermal energy for the recording performance required.

Regarding the typical structure and operational principle of such a method, it is preferable to adopt those which can be implemented using the fundamental principle disclosed in the specifications of U.S. Pat. Nos. 4,723,129 and 4,740,796. This method is applicable to a so-called on-demand type recording system and a continuous type recording system.

To describe this recording method briefly, at least one driving signal, which provides a rapid temperature rise beyond a departure from nucleation boiling point in liquid (ink) in response to recording information, is applied to an electrothermal transducer disposed for a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is ejected through a discharging port to produce at least one droplet. The driving signal is preferably in the form of a pulse because the development and contraction of the bubble can be exerted instantaneously, and therefore, the liquid (ink) is ejected with quick response. The driving signal in the form of the pulse is preferably such as disclosed in the specifications of U.S. Pat. Nos. 4,463,359 and 4,345,262. In addition, the temperature increasing rate of the thermoactive surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curbed area is also included in the present invention.

In addition, the present invention is applicable to the structure disclosed in Japanese Patent Laid-Open Application No. 59-123670 wherein a common slit is used as the discharging port for plural electrothermal transducers, and to the structure disclosed in Japanese Patent Laid-Open Application No. 59-138461 wherein an opening for absorbing pressure wave of the thermal energy is formed corresponding to the ejecting portion. In other words, according to the present invention, it becomes possible to operate the assuredly irrespective of the modes of the recording head.

Further, as a recording head for which the present invention can be utilized effectively, there is a full-line type recording head having a length corresponding to the maximum width of a recording medium recordable by the recording apparatus. This full-line head can be structured either by combining a plurality of recording heads disclosed in the above-mentioned patent specifications to form a full-line configuration or by a single full-line recording head which is integrally formed.

In addition, the present invention is effectively applicable to a replaceable chip type recording head which is connected electrically with the main apparatus and can be supplied with the ink when it is mounted in the main assembly, or to a cartridge type recording head which is integrally provided for the recording head itself.

Also, it is preferable to add to a recording apparatus according to the present invention recovery means for its recording head and preliminarily auxiliary means because such additional provision of these means will contribute to making the effects of the present invention more stable. To name them specifically, they are capping means for the recording head, cleaning means, compression or suction means, preliminary heating means such as electrothermal transducers or heating elements other than such transducing type or the combination of those types of elements, and the preliminary ejection mode besides the regular ejection for recording.

Furthermore, as the recording mode of a recording apparatus, the present invention is extremely effective in applying it not only to an apparatus capable of recording merely in one main color such as black, but also to an apparatus provided with at least one structure capable of recording in multiple colors composed of different colors or in a full-color produced by mixing colors, irrespective of whether such an apparatus is structured integrally with a recording head or structured by combining a plurality of heads.

Now, in the embodiments according to the present invention set forth above, while the ink has been described as liquid, it may be an ink material which is solidified below the room temperature but liquefied at the room temperature. Since the ink itself is controlled within the temperature not lower than 30° C. and not higher than 70° C. to stabilize its viscosity for the provision of the stabilized ejection in general, the ink may be such that it can be liquefied when the applicable recording signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being ejected as ink liquid by enabling itself to be liquefied anyway when the thermal energy is given in accordance with recording signals, an ink which will have already begun solidifying itself by the time it reaches a recording medium.

For an ink such as this, it may be possible to retain the ink as a liquid or solid material in through holes or recesses formed in a porous sheet as disclosed in Japanese Patent Laid-Open Application No. 54-56847 or Japanese Patent Laid-Open Application No. 60-71260 in order to exercise a mode whereby to enable the ink to face the electrothermal transducers in such a state.

For the present invention, the most effective method for each of the above-mentioned ink materials is the one which can implement the film boiling method described as above.

Figure 6:
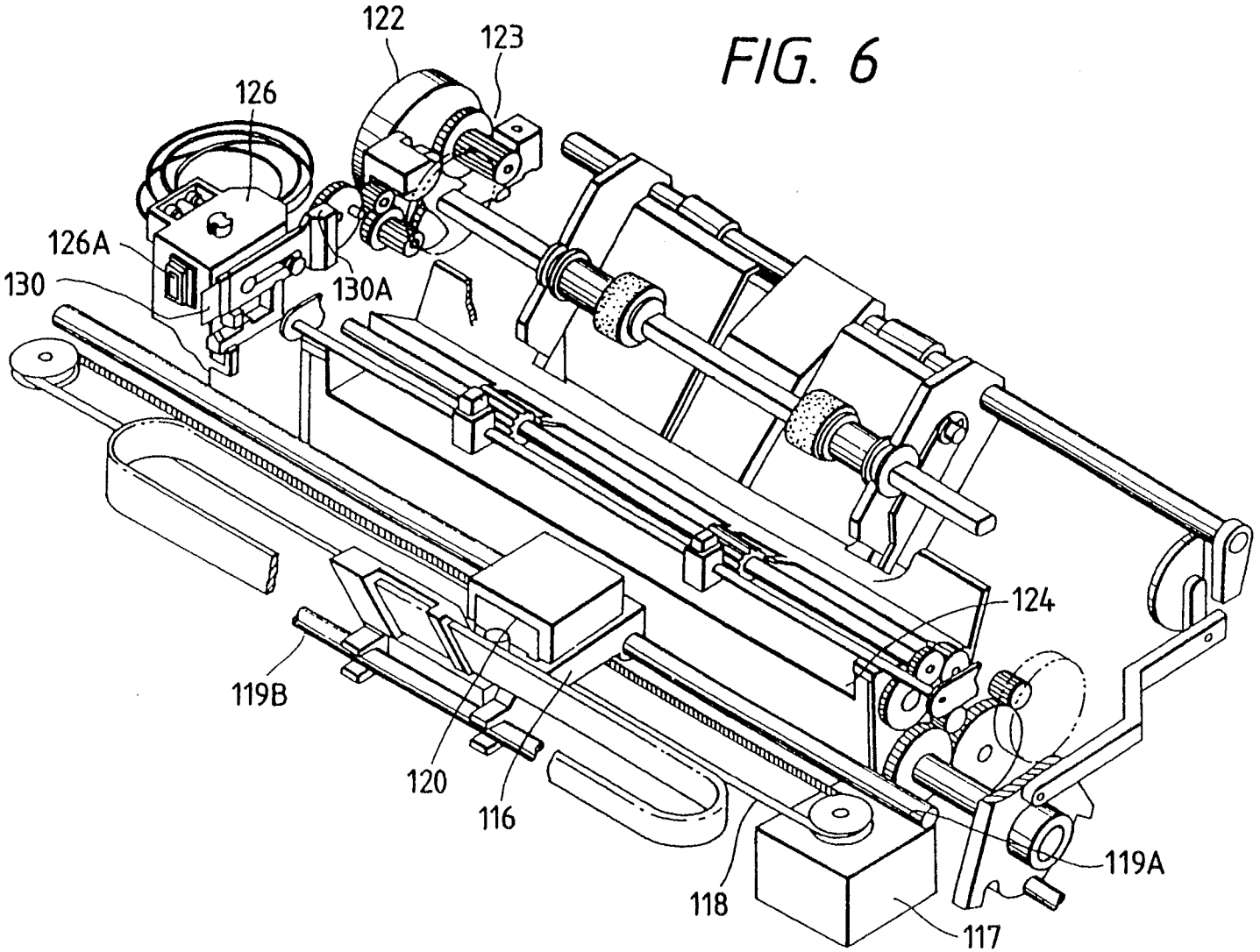
FIG. 6 is a perspective view illustrating an example of a recording apparatus provided with an ink jet recording head according to the present invention.

FIG. 6 is a perspective view showing the outer appearance of an example of the ink jet recording apparatus (IJRA) in which a recording head obtainable according to the present invention is installed as an ink jet head cartridge (IJC).

In FIG. 6, a reference numeral 120 designates an ink jet head cartridge (IJC) provided with a nozzle group capable of ejecting ink onto the recording surface of a recording sheet being fed on a platen 124; 116, a carriage HC to hold the IJC 120 and is coupled to a part of a driving belt 118 to transmit the driving force of a driving motor 117, which is slidably mounted on the two guide shafts 119A and 119B arranged in parallel to each other so as to enable the IJC 120 to reciprocate over the entire width of a recording sheet.

A reference numeral 126 designates a head recovery device arranged at one end of the carrier passage of the IJC 120, that is, a location facing its home position, for example. The head recovery device 126 is operated by the driving force of a motor 122 through a transmission mechanism 123 to perform the capping for the IJC 120. Being interlocked with the capping for the IJC 120 by means of the capping portion 126A of this head recovery device 126, an arbitrary sucking means arranged in the head recovery device 126 sucks ink or an arbitrary compression means arranged in the ink supply passage for the IJC 120 exerts pressure on ink to be so as to eject it forcibly for discharge; thus performing the removal of the ink which has increased its viscosity in nozzles, and other ejection recovery treatments. Also, when recording is completed or in some other cases, capping is provided for the protection of the IJC.

A reference numeral 130 designates a blade arranged on the side face of the head recovery device 126, which is made of silicon rubber to serve as a wiping member. The blade 130 is held by a blade holding member 130A in cantilever fashion and is operated by means of the motor 122 and transmission mechanism 123 in the same manner as the head recovery device 126. It is capable of being coupled with the discharging surface of the IJC 120. In this way, the blade 130 is allowed to be protruded in the traveling passage of the IJC 120 with an appropriate timing while the IJC 120 is in operation or subsequent to the ejection recovery treatment using the head recovery device 126; hence making it possible to wipe dews, wets, or dust particles on the discharging port surface of the IJC 120 with the traveling operation of the IJC 120.

What is claimed is:

1. A method for manufacturing an ink jet head comprising the steps of:

forming a head main body by providing a positive resist layer to constitute ink passages for a substrate having ink ejection pressure generating means and then a ceiling member therewith;

forming a carbon-contained film for a surface where ink discharging ports of said head main body are formed;

conducting a fluoric plasma treatment to said carbon-contained film by utilizing a hydrofluoride compound; and removing said positive resist layer to form said ink passages communicating with said ink discharge ports.

2. A method for manufacturing an ink jet head according to claim 1, wherein either one of the fluoric plasma treatment and the positive resist layer removal process can be conducted earlier than the other.

3. A method for manufacturing an ink jet head according to claim 1, wherein said carbon-contained film is formed by either one of a discharging plasma method, a physical deposition method, a chemical deposition method, and a transfer method.

4. A method for manufacturing an ink jet head according to claim 1, wherein said ink ejection pressure generating means is an electrothermal transducer, and changes of ink state are caused by utilizing heat generated by said transducer for the ejection of ink.

5. A method for manufacturing an ink jet head comprising the steps of:

forming a head main body provided with a discharging port formation surface by a material containing carbon;

conducting a fluoric plasma treatment to the discharging port formation surface of said head main body by utilizing a hydrofluoride compound; and forming discharging ports on said discharging formation surface by utilizing laser.

6. A method for manufacturing an ink jet head according to claim 5, wherein said head main body has ink ejection pressure generating means which is an electrothermal transducer, and changes of ink state are caused by utilizing heat generated by said transducer for the ejection of ink.

7. A method for manufacturing an ink jet head according to claim 5, wherein for said head main body, a metallic film is provided for contacting surfaces other than said discharging port formation surface.

* * * * *

UNITED STATES PATENT AND TRADEMARK OFFICE

CERTIFICATE OF CORRECTION

PATENT NO. : 5,443,687

INVENTOR(S) : SHUJI KOYAMA, ET AL.

DATED : August 22, 1995

It is certified that error appears in the above-identified patent and that said Letters Patent is hereby corrected as shown below:

ON TITLE PAGE

In [56] References Cited, under FOREIGN PATENT DOCUMENTS:
"229749 7/1990 Japan" should read
--2-29749 7/1990 Japan--.

COLUMN 1

Line 60, "aceton." should read --acetone.--.

COLUMN 3

Line 25, "Jet" should read --jet--.
Line 37, "Jet" should read --jet--.

COLUMN 4

Line 39, "from" should read --form--.
Line 56, "removing" should read --remove--.

COLUMN 5

Line 37, "aceton." should read --acetone.--.
Line 44, "aceton" should read --acetone--.

COLUMN 6

Line 44, "phyro-" should read --hydro- --.

UNITED STATES PATENT AND TRADEMARK OFFICE

CERTIFICATE OF CORRECTION

PATENT NO. : 5,443,687

INVENTOR(S) : SHUJI KOYAMA, ET AL.

DATED : August 22, 1995

It is certified that error appears in the above-identified patent and that said Letters Patent is hereby corrected as shown below:

COLUMN 7

Line 22, "hydrofludie" should read --hydrofluoride--.
Line 25, "hydrophic" should read --hydrophilic--.
Line 52, "an" should read --a--.

COLUMN 8

Line 38, "the" should be deleted.

Signed and Sealed this

Twenty-sixth Day of December, 1995

Attest:

Bruce Lehman

BRUCE LEHMAN

Attesting Officer

Commissioner of Patents and Trademarks